US009984666B1

(12) United States Patent
Knight

(10) Patent No.: US 9,984,666 B1
(45) Date of Patent: May 29, 2018

(54) STRING INSTRUMENT TAILPIECE

(71) Applicant: Michael J. Knight, Ypsilanti, MI (US)

(72) Inventor: Michael J. Knight, Ypsilanti, MI (US)

( * ) Notice: Subject to any disclaimer, the term of this patent is extended or adjusted under 35 U.S.C. 154(b) by 0 days. days.

(21) Appl. No.: 15/652,401

(22) Filed: Jul. 18, 2017

Related U.S. Application Data

(60) Provisional application No. 62/450,390, filed on Jan. 25, 2017.

(51) Int. Cl.
*G10D 3/12* (2006.01)
*G10D 3/00* (2006.01)

(52) U.S. Cl.
CPC ..... *G10D 3/12* (2013.01); *G10D 3/003* (2013.01)

(58) Field of Classification Search
CPC ..... G10D 3/12
See application file for complete search history.

(56) References Cited

U.S. PATENT DOCUMENTS 349,308 A * 9/1886 Hodges ..... G10D 3/12 84/300
1,337,793 A * 4/1920 Poehland ..... G10D 3/12 84/302
1,416,568 A * 5/1922 Mazzocco ..... G10D 3/12 267/74
1,446,038 A * 2/1923 Fousse ..... G10D 3/12 84/302
1,791,977 A * 2/1931 Seckendorf ..... G10D 3/12 84/302
1,803,661 A * 5/1931 Swearingen ..... G10D 3/12 84/302
1,884,434 A * 10/1932 Wehmann ..... G10D 3/12 84/302
2,097,103 A * 10/1937 Pitsenbarger ..... G10D 3/12 84/299
2,265,885 A * 12/1941 Armstrong ..... G10D 3/12 84/299
2,680,987 A * 6/1954 Straton ..... G10D 3/12 84/302
2,971,422 A * 2/1961 Passa ..... G10D 3/12 84/302
4,672,877 A * 6/1987 Hoshino ..... G10D 3/12 84/267
6,635,812 B2 * 10/2003 Roth ..... G10D 3/12 84/297 R (Continued)

FOREIGN PATENT DOCUMENTS

WO 2010066870 A1 6/2010

OTHER PUBLICATIONS

Customuse 3D prints affordable "Custom Shop" guitars; Newatlas article dated Aug. 20, 2014.

*Primary Examiner* — Robert W Horn

(57) ABSTRACT

A string instrument tailpiece may include a lever including a tailcord. The string instrument tailpiece may also include a base coupled to the lever along a pivot axis such that the lever is pivotable about the pivot axis. The tailcord may engage an endpin of a string instrument. The tailcord may be under an engaged-tension when the lever is in an engaged position and a release-tension when the lever is in a release position. The engaged-tension may be greater than the release-tension. The tailcord may also be disengageable from the endpin when under the release-tension.

20 Claims, 4 Drawing Sheets

(56) References Cited

U.S. PATENT DOCUMENTS

| | | | | |
|---|---|---|---|---|
| 7,304,225 | B2 * | 12/2007 | Ricci | G10D 3/12 84/302 |
| 7,759,567 | B2 | 7/2010 | Marvin | |
| 7,872,185 | B1 | 1/2011 | Chadwick | |
| 2013/0014630 | A1 * | 1/2013 | Um | G10D 1/02 84/294 |

* cited by examiner

STRING INSTRUMENT TAILPIECE

CROSS-REFERENCE TO RELATED APPLICATIONS

This application claims priority to U.S. Provisional Patent Application No. 62/450,390, filed on Jan. 25, 2017, the contents of which are hereby incorporated by reference in their entirety.

BACKGROUND

In music using string instruments, melodies are produced by plucking, striking, or bowing musical strings that are under tension, causing the strings to vibrate and the instrument to emit a sound. The sound produced by a musical string, or its pitch, can be manipulated by increasing or decreasing the tension across the musical string, a process commonly referred to as tuning. To tune the instrument, the musician simply rotates a tuning peg connected to the musical string until the desired sound is produced.

In many cases, musical strings are wrapped around tuning pegs at an end of a neck of the instrument, extend across a bridge, and attach to an opposite end of the instrument. Stringed instruments, such as a double bass, violin, and cello, often utilize a tailpiece to connect musical strings to a body of the instrument. Traditionally, tailpieces include a single member and a tailcord. Musical strings are attached at one end of the member, while the tailcord is attached at an opposite end. The connection between the tailpiece and the body of the instrument is facilitated by the tailcord, which extends across a saddle of the instrument and wraps around an endpin located on the body of the instrument. As the tailcord indirectly connects the musical strings to the body of the instrument, the tailcord is subjected to the same collective tension force as the musical strings.

Traveling with a string instrument can be cumbersome and even more burdensome when transporting a larger instrument, such as a double bass. To make it easier for traveling musicians, some string instruments have been designed to collapse or break down into several pieces thus making them more compact and easier to store, carry, and transport. Collapsing or breaking down these types of string instruments may include removing or pivoting the neck of the instrument. As the musical strings are typically connected to both the neck and the body of the instrument in order for the neck to be modified, the musical strings generally need to be detached from either the neck or the body. Typically, the musical strings are left attached to the tuning pegs of the neck and are detached from the body of the instrument by removing the tailpiece, which is accomplished by detaching the tailcord from the endpin. Removal of the tailcord from the endpin may involve reducing the tension across the musical strings and, thus, the tailcord. To reduce the tension across musical strings of a string instrument utilizing a traditional tailpiece the tuning pegs are rotated. The bridge may then be removed to further reduce the tension of the musical strings, and ultimately the tailcord is removed from the endpin. Thus, the musician typically retunes the instrument each time the instrument is reassembled.

Accordingly, there is a need for an improved method and apparatus for reducing the tension across the musical strings of a string instrument.

SUMMARY

According to one aspect, a string instrument tailpiece includes a lever that includes a tailcord. The string instrument tailpiece also includes a base coupled to the lever along a pivot axis such that the lever is pivotable about the pivot axis. The tailcord engages an endpin of a string instrument and is under an engaged-tension when the lever is in an engaged position and a release-tension when the lever is in a release position, the engaged-tension being greater than the release-tension. The tailcord is disengageable from the endpin when under the release-tension.

According to another aspect, a string instrument includes a body that includes a neck and an endpin. The neck extends outwardly from the body and the endpin is arranged on an end of the body opposite the neck. The string instrument also includes a tailpiece including a lever, the lever including a tailcord. The tailpiece also includes a base coupled to the lever along a pivot axis, such that the lever is pivotable about the pivot axis. The tailcord engages the endpin and is under an engaged-tension when the lever is in an engaged position and a release-tension when the lever is in a release position, the engaged-tension being greater than the release-tension. The tailcord is disengageable from the endpin when under the release-tension. The string instrument also includes a pegbox arranged on an end of the neck opposite the body. The pegbox includes at least one tuning peg. The string instrument further includes a musical string coupled to the at least one tuning peg at one end and coupled to the base at an opposite end. The musical string extends across a bridge and is under a tension such that its vibration produces a sound.

According to another aspect, a method of manufacturing a string instrument tailpiece includes producing a base portion of a tailpiece and a lever portion of a tailpiece. Coupling a tailcord to the lever and coupling the base to the lever along a pivot axis. The base is coupled to the lever such that the lever is pivotable about the pivot axis and the tailcord can disengage an endpin of a string instrument when the lever is pivoted to a release position.

BRIEF DESCRIPTION OF THE DRAWINGS

Referring now to the drawings, exemplary illustrations are shown in detail. The drawings are representative examples, are not necessarily to scale, and certain features may be exaggerated to better illustrate and explain an innovative aspect of an illustrative example. Further, the exemplary illustrations described herein are not intended to be exhaustive or otherwise limiting or restricting to the precise form and configurations shown in the drawings and disclosed in the following detailed description. Exemplary illustrations are described in detail by referring to the drawings as follows.

DETAILED DESCRIPTION

Reference in the specification to "an exemplary illustration", an "example" or similar language means that a particular feature, structure, or characteristic described in connection with the exemplary approach is included in at least one illustration. The appearances of the phrase "in an illustration" or similar type language in various places in the specification are not necessarily all referring to the same illustration or example.

Various exemplary illustrations are provided herein of a string instrument tailpiece according to the disclosure. A tailpiece capable of altering the tension applied across the musical strings of a string instrument is disclosed.

Figure 1:
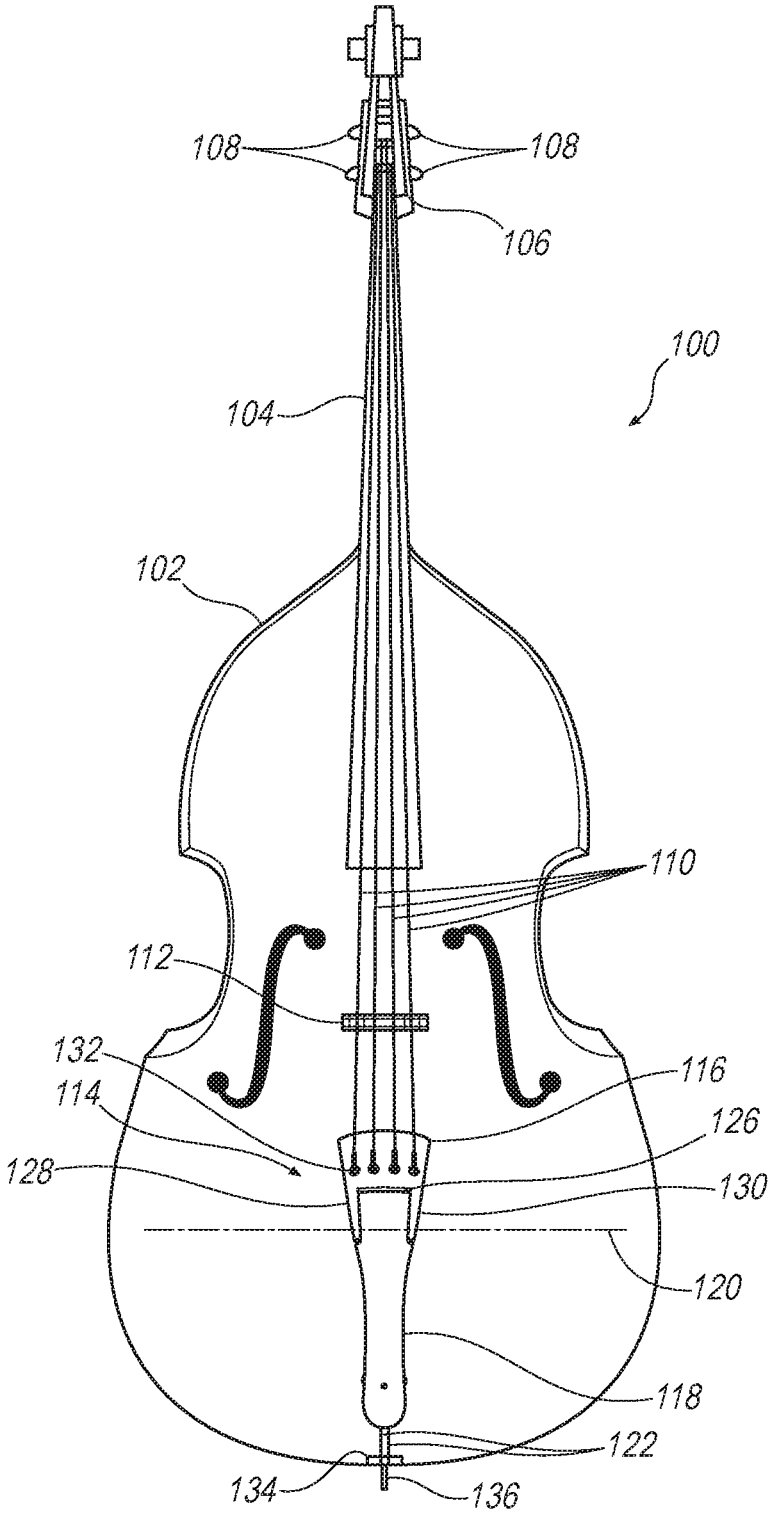
FIG. 1 illustrates a string instrument utilizing an exemplary tailpiece, according to the disclosure.

Turning now to FIG. 1, a string instrument 100 includes a body 102 having a neck 104 extending outwardly. At an end of neck 104 and opposite body 102 is a pegbox 106 including tuning pegs 108. While pegbox 106 illustrated in FIG. 1 has multiple tuning pegs 108, the string instrument 100 may include any number of tuning pegs 108 including a single tuning peg 108, depending on the type of instrument. Musical strings 110 are attached to the tuning pegs 108. Typically, string instrument 100 has the same number of tuning pegs 108 as musical strings 110 with each tuning peg 108 connected to a different string of musical strings 110. However, it is contemplated that in other examples, the number of tuning pegs 108 may not be the same as the number of musical strings 110, and that a single string of musical strings 110 may be attached to multiple tuning pegs 108, or that multiple strings of musical strings 110 may be attached to a single tuning peg 108. Alternate examples of string instrument 100 may include a plurality of musical strings 110 or a single musical string 110. The musical strings 110 are attached to tuning pegs 108 by wrapping musical strings 110 about tuning pegs 108. However, other methods of attaching musical strings 110 to tuning pegs 108 may be used.

Musical strings 110 extend along neck 104, across a bridge 112 that protrudes from body 102 in a direction approximately perpendicular to neck 104, and attach to a tailpiece 114, which is securable to body 102. Tailpiece 114 includes a tailcord 122 which is configured to engage an endpin 136 arranged on an end of body 102 opposite neck 104. Musical strings 110, tailpiece 114, and tailcord 122 are taut between tuning pegs 108 and endpin 136.

Bridge 112 can be of any type or shape, constructed in a variety of materials such as wood, metal, and plastic, and may be permanently attached to body 102, or may be removable.

Figure 2:
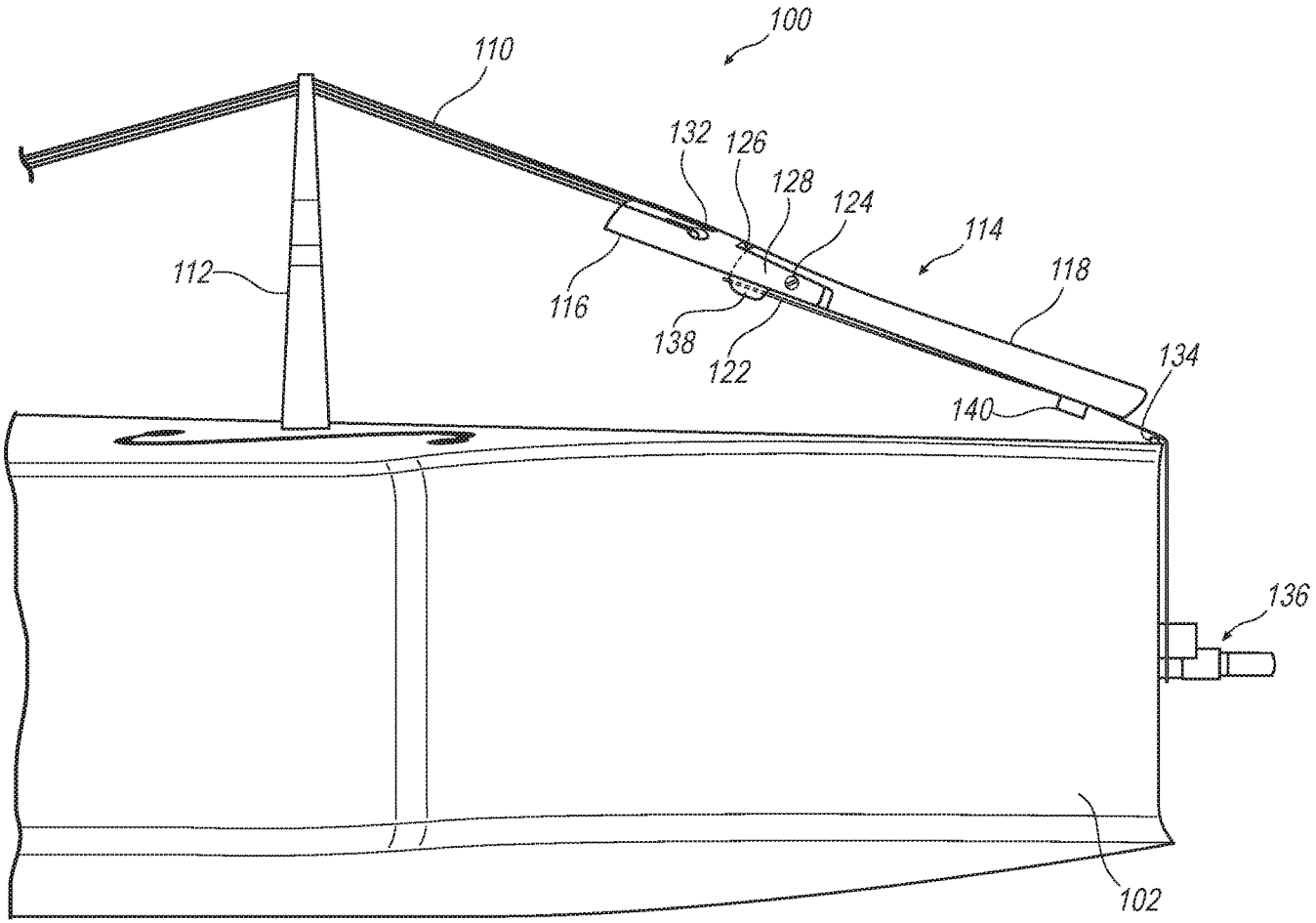
FIG. 2 illustrates a side view of a string instrument utilizing the disclosed tailpiece in an engaged position.

According to the disclosure, tailcord 122 may engage endpin 136 in a variety of ways. FIG. 2 depicts tailcord 122 engaging endpin 136 by looping around endpin 136. Other examples include tailcord 122 engaging endpin 136 via a hook, screw, or coupling.

Figure 3:
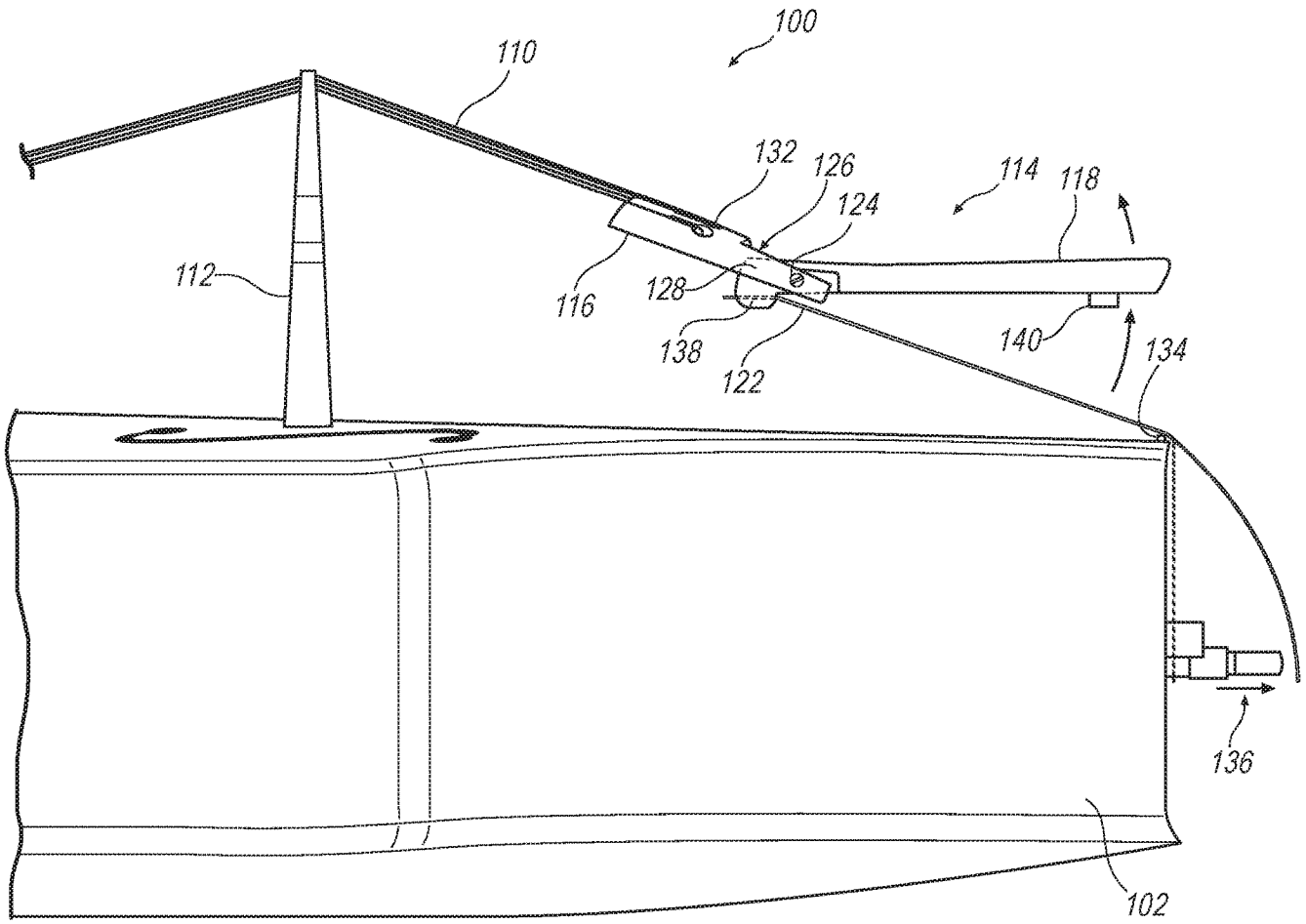
FIG. 3 illustrates a side view of a string instrument utilizing the disclosed tailpiece in a release position.

FIG. 3 illustrates tailcord 122 disengaging endpin 136 by removing tailcord 122 from endpin 136 while bridge 112 is still in place. It is contemplated that other methods could be used to disengage tailcord 122 from endpin 136 depending on how tailcord 122 engages endpin 136. Methods may include removing bridge 112 from body 102, removing endpin 136 from body 102, or removing both bridge 112 and endpin 136 from body 102.

Tailpiece 114 includes a base 116 coupled to a lever 118 along a pivot axis 120, such that lever 118 pivots about a pivot axis 120. Base 116 is coupled to lever 118 via a pivot-coupling 124. In FIGS. 1 thru 4, pivot-coupling 124 is depicted as a bolt that passes through base 116 and lever 118 along pivot axis 120 and is secured by a nut. However, it is contemplated that pivot-coupling 124 could be any other type of axial rotational coupling such as a single or series of fasteners, a screw, pin, dowel, rod, wire, or any other elongated member passing through both base 116 and lever 118. It is also contemplated that pivot-coupling 124 may include one or more portions of base 116 being retained in one or more recesses in lever 118 or one or more portions of lever 118 being retained in one or more recesses in base 116.

Figure 4:
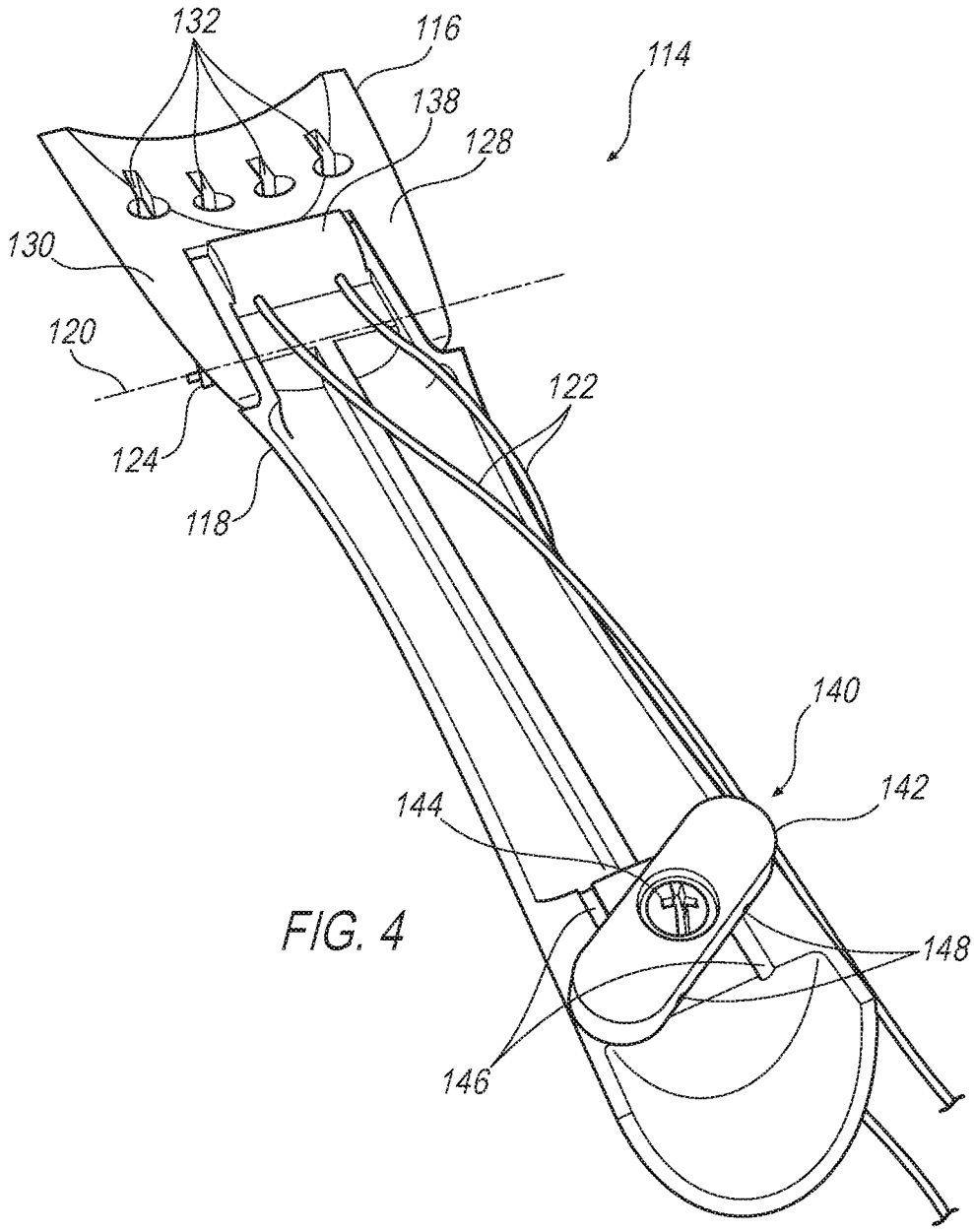
FIG. 4 illustrates a backside view of the disclosed tailpiece.

FIGS. 1 thru 4 depict tailcord 122 as a loop coupled to lever 118 via a cord coupling 138. Cord coupling 138 in FIGS. 2 thru 4 is illustrated as tailcord 122 passing through a portion of lever 118. However, a variety of tailcord 122 configurations and lengths are suitable for use in the disclosed tailpiece 114. For example, tailcord 122 may be a cord with both ends separately coupled to lever 118, such that tailcord 122 forms a loop which engages endpin 136. In another example, tailcord 122 is coupled to lever 118 at one end and includes a loop, hook, or fastener on the other end configured to engage endpin 136. Additionally, cord coupling 138 need not be tailcord 122 passing through a portion of lever 118. For example, cord coupling 138 could be a fastener, screw, or glue. Other examples may not include cord coupling 138, as tailcord 122 may be integral to lever 118.

As illustrated in FIGS. 1 thru 4, base 116 includes a pivot-recess 126. Pivot-recess 126 is configured such that, when lever 118 is pivoted about pivot axis 120, a portion of lever 118 may pass through it. Additionally, pivot axis 120 passes through pivot-recess 126. The shape and dimensions of pivot-recess 126 may compliment that of lever 118 to facilitate easy passage of lever 118 through pivot-recess 126. Alternate examples of base 116 may include pivot-recess 126 having any desired shape and dimensions, or may not include pivot-recess 126 at all.

Other examples of base 116 may include a first rotation arm 128 and a second rotation arm 130 that extend outwardly from base 116 in a direction approximately perpendicular to pivot axis 120 and are approximately parallel to one another. In these examples, first rotation arm 128 and second rotation arm 130, together with base 116, define pivot-recess 126. Base 116 is coupled through first rotation arm 128 and second rotation arm 130 to lever 118 via pivot-coupling 124.

With regard to FIGS. 1 thru 3, musical strings 110 are attached to tailpiece 114 by passing through string holes 132 in base 116, musical strings 110 including a ball, knob, bead, cylinder, or other kind of extended portion that is thicker than the rest of musical string 110 and too large to fit through at least a portion of string holes 132. However, other connections may also be used to attach musical strings 110 to base 116.

As musical strings 110, tailpiece 114, and tailcord 122 are taut between tuning pegs 108 and endpin 136, they are under tension. This tension can be altered by increasing or decreasing the collective length of musical strings 110, tailpiece 114, and tailcord 122 stretched between tuning pegs 108 and endpin 136. In string instruments utilizing a traditional tailpiece there is no way to adjust or change the length of the tailpiece or tailcord. Therefore, to adjust the tension the length of the musical strings would be altered by rotating the tuning pegs. Operation of disclosed tailpiece 114 allows the tension to be altered without rotating tuning pegs 108 or altering the length of musical strings 110.

In FIG. 1 and FIG. 2, lever 118 is in an engaged position wherein tailcord 122 extends across a saddle 134 arranged on body 102, loops around endpin 136, and engages endpin 136. Saddle 134, in various examples, is metal, wood, plastic, or other material arranged between musical strings 110 and body 102 to prevent musical strings 110 from rubbing against and damaging body 102. When lever 118 is in the engaged position, musical strings 110 and tailcord 122 are at an engaged-tension. The engaged-tension is a tension where tailcord 122 cannot readily be removed from endpin 136, nor can bridge 112 be readily removed from body 102, thereby allowing the user to tune musical strings 110 and play string instrument 100 as they ordinarily would with a traditional tailpiece.

The tension across musical strings 110 and tailcord 122 can be reduced by pivoting lever 118 about pivot axis 120 to a release position. As depicted in FIG. 3, pivoting lever 118 to the release position moves cord coupling 138 further from string holes 132, thereby increasing the length of tailpiece 114 between musical strings 110 and tailcord 122. As a result, the collective length of musical strings 110, tailpiece 114, and tailcord 122 being stretched between tuning pegs 108 and endpin 136 is increased and the tension across them is reduced. Thus, when lever 118 is in the release position, musical strings 110 and tailcord 122 are at a release-tension that is lower than the engaged-tension. The release-tension is a tension where bridge 112 can be removed from body 102, and tailcord 122 can subsequently disengage endpin 136 or tailcord 122 can disengage endpin 136 while bridge 112 is still in place.

Various examples of tailpiece 114 include a securing mechanism 140 configured to ensure lever 118 remains in the engaged position. Securing mechanism 140 is arranged on lever 118 such that it is able to engage tailcord 122 when lever 118 is in the engaged position. The exemplary securing mechanism 140 illustrated in FIG. 4 includes a locking member 142 rotatably coupled to lever 118 via a rotational coupling 144 such that locking member 142 may rotate between a locked position and an unlocked position. In the unlocked position locking member 142 is substantially parallel to a longitudinal axis of lever 118, while in the locked position locking member 142 is substantially perpendicular to the longitudinal axis of lever 118. When lever 118 is in the engaged position, locking member 142 can be rotated from the unlocked position to the locked position thereby securing tailcord 122 between lever 118 and locking member 142, ensuring that lever 118 cannot be pivoted to the release position.

Rotational coupling 144 is illustrated in FIG. 4 as a screw. It is contemplated that rotational coupling 144 could also be a pin, dowel, rod, or other coupling device that allows locking member 142 to rotate.

Other contemplated variations of securing mechanism 140 may also include a lever channel 146 extending substantially perpendicular to pivot axis 120 along at least a portion of lever 118. Lever channel 146 is configured to receive at least a portion of tailcord 122. Tailcord 122 may be arranged to rest within lever channel 146 when locking member 142 is in the locked position to further restrict movement of tailcord 122, thereby reducing the likelihood of tailcord 122 coming dislodged from securing mechanism 140. To further reduce this likelihood, locking member 142 may include a locking member channel 148 configured to receive at least a portion of tailcord 122. When locking member 142 is in the locked position, locking member channel 148 extends approximately perpendicular to pivot axis 120. Variations of tailpiece 114 could be configured to include both lever channel 146 and locking member channel 148 and for each to simultaneously receive a portion of tailcord 122 when locking member 142 is in the locked position.

Tailpiece 114 may be utilized by an array of string instruments 100 such as violins, cellos, double basses, etc. Tailpiece 114 may also be constructed out of a variety of materials or a combination of materials such as plastic, metal, wood, nylon, aluminum, and carbon fiber. Factors such as strength, weight, durability, rigidity, density, vibration characteristics, characteristics of the sound produced, cost, and post-production customization options are often considered when selecting the material or combination of materials to be used in the construction of tailpiece 114. Likewise, tailcord 122 may be constructed from a variety of materials or a combination of materials such as wire, braided wire, gut, nylon, Kevlar, and other such materials.

Aside from facilitating the connection between the musical strings and the body, traditional single member tailpieces provided little functionality. The two-piece pivotable construction of the disclosed tailpiece allows musicians and other users to do things not possible with a traditional tailpiece.

In string instruments utilizing a traditional tailpiece, removing the musical strings from the instrument may involve detaching the musical strings from each tuning peg or from the body of the instrument. As attaching each musical string to a tuning peg is time consuming and burdensome, most users opt to detach the musical strings from the body. This often involves removing the tailpiece by disengaging the tailcord from the endpin. To accomplish this, the user reduces the tension in the tailcord by reducing the tension in the musical strings. Once the tension is reduced, the user would then disengage the tailcord from the endpin or, if tension needed to be reduced further, remove the bridge and then disengage the tailcord. To alter tension across the musical strings the user would rotate the tuning pegs. Rotating the tuning pegs allows the user to alter the tension of each musical string and thereby tune each musical string to produce the desired pitch. However, this also means that each time the user desired the tailcord be disengaged the user would detune each musical string and then retune each musical string once the tailcord is reengaged. Therefore, even removing and reattaching the musical strings to the body of the instrument is a slow, cumbersome process.

The disclosed tailpiece allows users to avoid these drawbacks by altering the collective tension across all the musical strings and tailcord without detuning the instrument. When the lever is in the engaged position, the musical strings and tailcord are under an engaged-tension. When under the engaged-tension the user can play the string instrument and alter the tension of each musical string to produce the desired pitch by rotating the tuning pegs. When the musical strings need to be detached, the user simply pivots the lever from the engaged position to the release position. By doing so, the collective tension across the tailcord and the musical strings is reduced, allowing the user to disengage the tailcord from the endpin. Once the musical strings are to be reattached, generally after the musical strings have been secured to the tuning pegs, the tailcord is placed back into position to engage the endpin and the user rotates the lever to the engaged position, thereby returning the musical strings and tailcord to the engaged-tension. As the tuning pegs have not been rotated in this process, each musical string will be returned to the tension previously set by the user and the string instrument will still be in tune. As a result of using the disclosed tailpiece, users can detach and reattach musical strings to their instruments quickly, efficiently, and with only minor tuning adjustments.

The advantages provided by use of the disclosed tailpiece are invaluable to musicians who play collapsible string instruments, which frequently involve detaching/reattaching the musical strings during assembly/disassembly, as the amount of time needed to break down and setup their instruments is greatly reduced.

Users of traditional string instruments also benefit. Maintenance tasks such as cleaning the instrument, replacing a broken bridge, tailpiece, neck, opening the body, resurfacing a face of the body, and other activities involving detaching the musical strings are far easier to perform. With maintenance tasks such as these being quicker and easier, users may perform such tasks more often and possibly extend the life of their instrument.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

Accordingly, it is to be understood that the above description is intended to be illustrative and not restrictive. Many embodiments and applications other than the examples provided would be conceivable upon reading the above description. It is anticipated and intended that future developments will occur in the arts discussed herein, and that the disclosed systems and methods will be incorporated into such future embodiments. In sum, it should be understood that the invention is capable of modification and variation.

All terms used in the claims are intended to be given their broadest reasonable constructions and their ordinary meanings as understood by those skilled in the art unless an explicit indication to the contrary is made herein. In particular, use of the singular articles such as "a," "the," "said," etc. should be read to recite one or more of the indicated elements unless a claim recites an explicit limitation to the contrary.

What is claimed is:

1. A string instrument tailpiece, comprising:

a lever including a tailcord; and a base coupled to the lever along a pivot axis such that the lever is pivotable about the pivot axis;

wherein the tailcord engages an endpin of a string instrument and is under an engaged-tension when the lever is in an engaged position and a release-tension when the lever is in a release position, the engaged-tension being greater than the release-tension; and wherein the tailcord is disengageable from the endpin when under the release-tension.

2. The string instrument tailpiece according to claim 1, further comprising a securing mechanism coupled to the lever and configured to hold the lever in the engaged position by engaging the tailcord.

3. The string instrument tailpiece according to claim 2, wherein the securing mechanism includes a locking member rotatably coupled to the lever such that the tailcord is securable between the locking member and the lever when the locking member is in a locked position.

4. The string instrument tailpiece according to claim 3, wherein at least one of:

the lever includes a lever channel extending substantially perpendicular to the pivot axis and configured to receive at least a portion of the tailcord; and the locking member includes a locking member channel extending substantially perpendicular to the pivot axis when the locking member is in the locked position and configured to receive at least a portion of the tailcord.

5. The string instrument tailpiece according to claim 1, wherein the base includes a pivot-recess configured to pass at least a portion of the lever through the pivot-recess when the lever is pivoted about the pivot axis.

6. The string instrument tailpiece according to claim 5, wherein the base includes a first rotation arm and a second rotation arm that extend outwardly from the base and are substantially parallel to one another, wherein the pivot-recess is defined by the first rotation arm, the second rotation arm, and the base, and wherein the base is coupled to the lever along the pivot axis via the first rotation arm and the second rotation arm.

7. The string instrument tailpiece according to claim 1, wherein the tailcord is disengageable from the endpin when under the release-tension and a bridge of the string instrument is in place.

8. The string instrument tailpiece according to claim 1, further comprising:

a locking member rotatably coupled to the lever such that the tailcord is securable between the locking member and the lever when the locking member is in a locked position thereby holding the lever in the engaged position;

a first rotation arm and a second rotation arm extending outwardly from the base such that the first rotation arm and the second rotation arm are substantially parallel to one another; and a pivot-recess defined by the first rotation arm, the second rotation arm, and the base, the pivot-recess configured to pass at least a portion of the lever through the pivot-recess when the lever is pivoted about the pivot axis;

wherein the lever is coupled to the base along the pivot axis via the first rotation arm and the second rotation arm.

9. A string instrument comprising:

a body including a neck and an endpin, the neck extending outwardly from the body and the endpin arranged on an end of the body opposite the neck;

a tailpiece including:

a lever including a tailcord; and a base coupled to the lever along a pivot axis such that the lever is pivotable about the pivot axis;

wherein the tailcord engages the endpin and is under an engaged-tension when the lever is in an engaged position and a release-tension when the lever is in a release position, the engaged-tension being greater than the release-tension; and wherein the tailcord is disengageable from the endpin when under the release-tension;

a pegbox arranged on an end of the neck opposite the body, the pegbox including at least one tuning peg; and a musical string coupled to the at least one tuning peg at one end and coupled to the base at an opposite end;

wherein the musical string extends across a bridge and is under a tension such that its vibration produces a sound.

10. The string instrument according to claim 9, wherein the tailpiece includes a securing mechanism coupled to the lever and configured to hold the lever in the engaged position by engaging the tailcord.

11. The string instrument according to claim 10, wherein the securing mechanism includes a locking member rotatably coupled to the lever such that the tailcord is securable between the locking member and the lever when the locking member is in a locked position.

12. The string instrument according to claim 11, wherein at least one of:

the lever includes a lever channel extending substantially perpendicular to the pivot axis and configured to receive at least a portion of the tailcord; and the locking member includes a locking member channel extending substantially perpendicular to the pivot axis when the locking member is in the locked position and configured to receive at least a portion of the tailcord.

13. The string instrument according to claim 9, wherein the base includes a pivot-recess configured to pass at least a portion of the lever through the pivot-recess when the lever is pivoted about the pivot axis.

14. The string instrument according to claim 13, wherein the base includes a first rotation arm and a second rotation arm that extend outwardly from the base and are substantially parallel to one another, wherein the pivot-recess is defined by the first rotation arm, the second rotation arm, and the base, and wherein the base is coupled to the lever along the pivot axis via the first rotation arm and the second rotation arm.

15. The string instrument according to claim 9, wherein the tailcord is disengageable from the endpin when under the release-tension and a bridge of the string instrument is in place.

16. The string instrument according to claim 9, wherein the tailpiece includes:

a locking member rotatably coupled to the lever such that the tailcord is securable between the locking member and the lever when the locking member is in a locked position thereby holding the lever in the engaged position;

a first rotation arm and a second rotation arm extending outwardly from the base such that the first rotation arm and the second rotation arm are substantially parallel to one another; and a pivot-recess defined by the first rotation arm, the second rotation arm, and the base, the pivot-recess configured to pass at least a portion of the lever through the pivot-recess when the lever is pivoted about the pivot axis;

wherein the base is coupled to the lever along the pivot axis via the first rotation arm and the second rotation arm.

17. A method of manufacturing a string instrument tailpiece comprising:

producing a base portion of a tailpiece and a lever portion of a tailpiece;

coupling a tailcord to the lever; and coupling the base to the lever along a pivot axis such that the lever is pivotable about the pivot axis and the tailcord can disengage an endpin of a string instrument when the lever is pivoted to a release position.

18. The method of manufacturing a string instrument tailpiece according to claim 17, wherein producing a base portion includes producing a base portion of a tailpiece including a first rotation arm and a second rotation arm that extend outwardly from the base and substantially parallel to one another, and wherein coupling the base to the lever includes coupling the first rotation arm and the second rotation arm to the lever along the pivot axis such that the lever is pivotable about the pivot axis.

19. The method of manufacturing a string instrument tailpiece according to claim 17, further comprising coupling a securing mechanism to the lever, the securing mechanism configured to hold the lever in an engaged position by engaging the tailcord.

20. The method of manufacturing a string instrument tailpiece according to claim 17, further comprising creating a lever channel in the lever extending substantially perpendicular to the pivot axis and configured to receive at least a portion of the tailcord.

* * * * *